US008693936B2

(12) United States Patent
Nanno et al.

(10) Patent No.: US 8,693,936 B2
(45) Date of Patent: Apr. 8, 2014

(54) FIXING DEVICE AND IMAGE FORMING APPARATUS INCORPORATING SAME

(75) Inventors: Shigeo Nanno, Kyoto (JP); Tomohiko Fujii, Hyogo (JP); Yutaka Naitoh, Hyogo (JP); Tomoya Adachi, Hyogo (JP); Minoru Toyoda, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 114 days.

(21) Appl. No.: 13/346,061

(22) Filed: Jan. 9, 2012

(65) Prior Publication Data

US 2012/0177422 A1 Jul. 12, 2012

(30) Foreign Application Priority Data

Jan. 11, 2011 (JP) ..... 2011-003396

(51) Int. Cl.
*G03G 15/20* (2006.01)

(52) U.S. Cl.
USPC ..... 399/329; 399/330

(58) Field of Classification Search
USPC ..... 399/330
See application file for complete search history.

(56) References Cited

U.S. PATENT DOCUMENTS

| | | | | |
|---|---|---|---|---|
| 5,148,226 | A * | 9/1992 | Setoriyama et al. | 399/329 |
| 6,122,478 | A * | 9/2000 | Hirst | 399/330 |
| 6,795,679 | B2 * | 9/2004 | Shimizu et al. | 399/333 |
| 7,428,400 | B2 | 9/2008 | Iwakura et al. | |
| 7,499,669 | B2 | 3/2009 | Adachi et al. | |
| 7,599,633 | B2 | 10/2009 | Inoue et al. | |
| 7,636,539 | B2 | 12/2009 | Kawasaki et al. | |
| 7,702,248 | B2 | 4/2010 | Adachi et al. | |
| 7,734,235 | B2 | 6/2010 | Takehara et al. | |
| 7,735,634 | B2 | 6/2010 | Miyazaki et al. | |
| 7,751,751 | B2 | 7/2010 | Ohta et al. | |
| 7,769,332 | B2 | 8/2010 | Yamamoto et al. | |
| 7,778,573 | B2 | 8/2010 | Yamashita et al. | |
| 7,801,471 | B2 | 9/2010 | Adachi et al. | |
| 7,869,751 | B2 | 1/2011 | Adachi et al. | |
| 7,873,303 | B2 | 1/2011 | Ohta et al. | |
| 7,878,725 | B2 | 2/2011 | Ohkubo et al. | |

(Continued)

FOREIGN PATENT DOCUMENTS

| | | |
|---|---|---|
| JP | 2008-146010 | 6/2008 |
| JP | 2010-96782 | 4/2010 |

OTHER PUBLICATIONS

U.S. Appl. No. 13/067,907, filed Jul. 6, 2011.

*Primary Examiner* — Clayton E LaBalle
*Assistant Examiner* — Jas Sanghera
(74) *Attorney, Agent, or Firm* — Oblon, Spivak, McClelland, Maier & Neustadt, L.L.P.

(57) ABSTRACT

A fixing device includes a heat pipe, a fuser belt, a heater, a fuser pad, a pressure member, and a coupling mechanism. The heat pipe is formed of a sheet of metal bent into a generally cylindrical configuration with a pair of opposed longitudinal edges thereof spaced apart from each other to define a longitudinal slot therebetween. The fuser belt is looped for rotation around the heat pipe. The heater is disposed within the heat pipe to heat the heat pipe to conduct heat to the fuser belt. The fuser pad is accommodated in the longitudinal slot of the heat pipe inside the loop of the fuser belt. The pressure member is disposed parallel to the heat pipe with the fuser belt interposed between the fuser pad and the pressure member. The coupling mechanism includes a pair of first coupling portion and a pair of second coupling portions.

11 Claims, 6 Drawing Sheets

(56) References Cited

U.S. PATENT DOCUMENTS

| | | | | |
|---|---|---|---|---|
| 7,881,635 | B2 | 2/2011 | Yamazoe et al. | |
| 7,890,017 | B2 | 2/2011 | Naitoh et al. | |
| 7,945,203 | B2 | 5/2011 | Shimizu et al. | |
| 7,982,923 | B2 | 7/2011 | Andoh et al. | |
| 2002/0067936 | A1* | 6/2002 | Yasui et al. | 399/329 |
| 2003/0039492 | A1* | 2/2003 | Hamada et al. | 399/329 |
| 2007/0065201 | A1 | 3/2007 | Fujiwara et al. | |
| 2007/0279888 | A1 | 12/2007 | Nanno et al. | |
| 2007/0285701 | A1 | 12/2007 | Ohta et al. | |
| 2008/0180762 | A1 | 7/2008 | Andoh et al. | |
| 2009/0010680 | A1 | 1/2009 | Nanno | |
| 2009/0016772 | A1 | 1/2009 | Adachi et al. | |
| 2009/0022531 | A1 | 1/2009 | Kubota et al. | |
| 2009/0074440 | A1 | 3/2009 | Nanno et al. | |
| 2009/0110449 | A1 | 4/2009 | Saito et al. | |
| 2009/0129836 | A1 | 5/2009 | Sakaya et al. | |
| 2009/0162101 | A1 | 6/2009 | Yoshida et al. | |
| 2009/0162772 | A1 | 6/2009 | Fuwa et al. | |
| 2009/0274485 | A1 | 11/2009 | Adachi et al. | |
| 2010/0034548 | A1 | 2/2010 | Naitoh et al. | |
| 2010/0232848 | A1 | 9/2010 | Naitoh | |
| 2011/0008082 | A1 | 1/2011 | Nanno | |
| 2011/0026944 | A1 | 2/2011 | Naitoh | |
| 2011/0103837 | A1 | 5/2011 | Toyoda et al. | |
| 2011/0142495 | A1 | 6/2011 | Nanno | |

* cited by examiner

FIXING DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-003396, filed on Jan. 11, 2011, the entire disclosure of which is hereby incorporated by reference herein.

BACKGROUND OF THE INVENTION

1. Technical Field

The present invention relates to a fixing device, and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of these features, which employs such a fixing device.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner (a "fuser member") and the other being pressed against the heated belt or roller (a "pressure member"), which together form a heated area of contact called a fixing nip, through which a recording medium is passed to fix a toner image onto the medium under heat and pressure.

For example, one such fixing device includes a rotatable, elastic fuser belt paired with an elastically biased, rotatably driven pressure roller. The fuser belt is looped into a generally cylindrical configuration for rotation around a thermally conductive heat pipe, within which a heater is situated to radiate heat to the heat pipe from inside the loop of the fuser belt. The pressure roller is disposed opposite a fuser pad, which is disposed inside the loop of the fuser belt at the area of the fixing nip to support the fuser belt against pressure from the pressure roller, with the fuser belt interposed between the fuser pad and the pressure roller. The fixing device also includes a biasing mechanism, such as a spring, which elastically biases the pressure roller against the fuser pad through the fuser belt to form the above-described fixing nip therebetween.

Upon activation, the fixing device initially heats the fuser belt to an operational temperature during warm-up, in which the heater heats the heat pipe to conduct heat to the fuser belt, whereas the pressure roller rotates to in turn rotate the fuser belt to allow uniform heating in the circumferential, rotational direction of the fuser belt. After completion of warm-up, a recording medium is conveyed through the fixing nip, at which a toner image on the incoming medium is fixed in place with heat from the fuser belt and pressure from the pressure roller pressing against the fuser belt.

The heat pipe employed in this type of fixing device is configured as a longitudinally slotted metal tube formed by bending a sheet of metal, such as stainless steel, into a generally cylindrical configuration, with a pair of opposed longitudinal edges thereof folded inward and spaced apart from each other to define a concave, longitudinal slot therebetween that extends the entire length of the heat pipe. The heat pipe is inserted into the loop of the fuser belt while accommodating the fuser pad in its longitudinal side slot, so that an outer circumferential surface of the heat pipe adjoins an inner circumferential surface of the fuser belt except at the fixing nip where the fuser pad is disposed in the assembled fixing device.

One problem encountered when using such a longitudinally slotted heat pipe in the fixing device is deformation of the heat pipe, in which the pair of opposed longitudinal edges of the metal sheet gradually separates further from each other to enlarge the gap or opening therebetween due to an elastic recovery of the bent sheet of metal, known in the art as "springback". If not corrected, such deformation of the heat pipe would result in localized sliding contact between the heat pipe and the fuser belt that accelerates wear and tear of the fuser belt.

To address this problem, one possible approach is to provide a fastener or connecting member to fix the opposed, longitudinal slot-defining edges of the heat pipe in position with respect to each other. For example, such a fastener may be a pair of mechanical clamps or stays shaped with a rectangular U-shaped cross section to conform to the folded configuration of the opposed longitudinal edges of the heat pipe. These stays are fitted to the longitudinal side slot, one from inside and the other from outside the heat pipe, so as to clamp together the opposed longitudinal edges, thereby retaining the heat pipe in the desired shape. However, the stays are unsatisfactory in that they complicate assembly and increase costs.

SUMMARY OF THE INVENTION

Exemplary aspects of the present invention are put forward in view of the above-described circumstances, and provide a novel fixing device.

In one exemplary embodiment, the fixing device includes a heat pipe, a rotatable, flexible fuser belt, a heater, a stationary fuser pad, a rotatably driven pressure member, and a coupling mechanism. The heat pipe is formed of a sheet of metal bent into a generally cylindrical configuration with a pair of opposed longitudinal edges thereof spaced apart from each other to define a longitudinal slot therebetween. The fuser belt is looped for rotation around the heat pipe, with variable clearance between the inner surface of the fuser belt and the outer surface of the heat pipe. The heater is disposed within the heat pipe to heat the heat pipe to conduct heat to the fuser belt. The fuser pad is accommodated in the longitudinal slot of the heat pipe inside the loop of the fuser belt. The pressure member is disposed parallel to the heat pipe with the fuser belt interposed between the fuser pad and the pressure member. The pressure member presses against the fuser pad through the fuser belt to form a fixing nip therebetween, through which a recording medium is conveyed under heat and pressure. The coupling mechanism includes a pair of first coupling portions and a pair of second coupling portions. The pair of first coupling portions is disposed in the fuser pad, one on each longitudinal edge of the fuser pad. The pair of second coupling portions is disposed in the heat pipe, one in each of the pair of opposed longitudinal edges of the bent sheet of metal. The first coupling portion is engageable with the second coupling portion to couple together the pair of opposed longitudinal edges to retain the heat pipe in the generally cylindrical configuration.

Other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
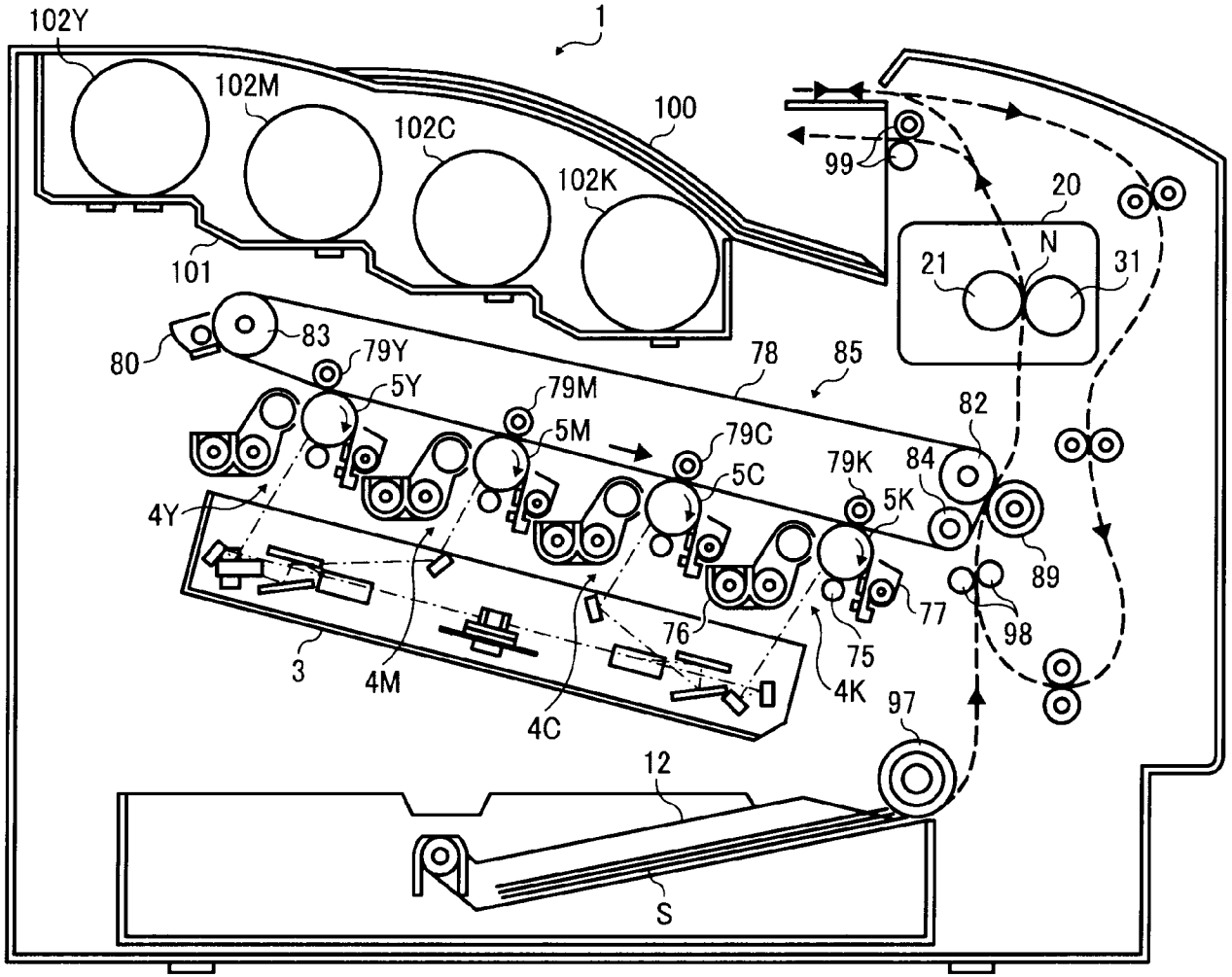
FIG. 1 schematically illustrates an image forming apparatus incorporating a fixing device according to one or more embodiments of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one or more embodiments of this patent specification.

Figure 3:
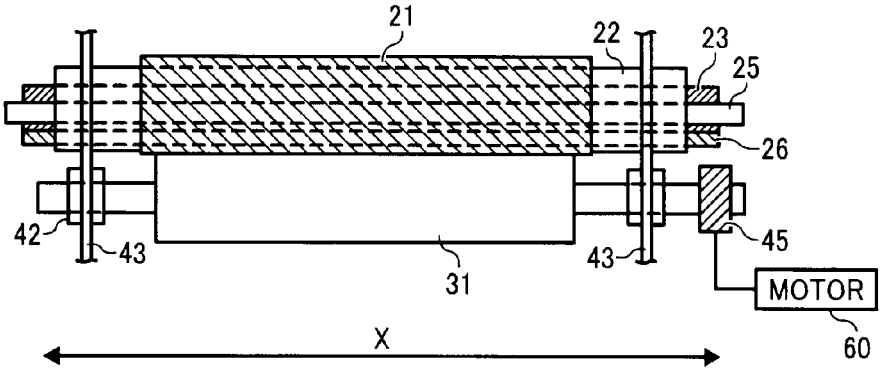
FIG. 3 is a transverse view of the fixing device of FIG. 2.

As shown in FIG. 3, the image forming apparatus 1 is a tandem color printer including four imaging stations 4Y, 4M, 4C, and 4K arranged in series along the length of an intermediate transfer unit 85 and adjacent to an exposure unit 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, and a discharging device, which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from detachably attached, replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the exposure unit 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 is supplied with a bias voltage of a polarity opposite that of the toner on the photoconductor drum 5. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
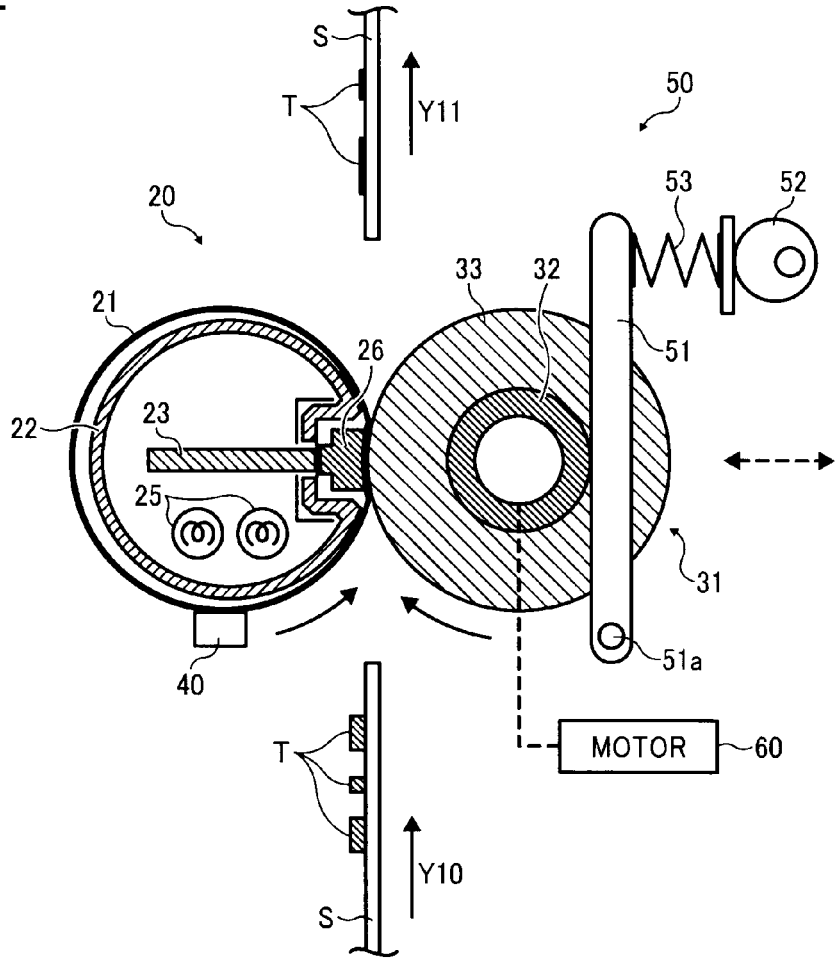
FIG. 2 is an end-on, axial cutaway view of the fixing device incorporated in the image forming apparatus of FIG. 1.

FIGS. 2 and 3 are end-on, axial cutaway and transverse views, respectively, of the fixing device 20 incorporated in the image forming apparatus 1 according to one or more embodiments of this patent specification.

As shown in FIGS. 2 and 3, the fixing device 20 includes a tubular heat pipe 22; a rotatable, flexible fuser belt 21 looped for rotation around the heat pipe 22; a heater 25 disposed within the heat pipe 22 to heat the heat pipe 22 to conduct heat to the fuser belt 21; an elongated, stationary fuser pad 26 accommodated inside the loop of the fuser belt 21; a rotatably driven pressure roller 31, and disposed parallel to the heat pipe 22 with the fuser belt 21 interposed between the fuser pad 26 and the pressure roller 31.

Also included in the fixing device 20 is a biasing mechanism 50 that elastically biases the pressure roller 31 against the fuser assembly with an adjustable pressure, so that the pressure roller 31 presses against the fuser pad 26 through the fuser belt 21 to form a fixing nip N therebetween. A rotary drive motor 60 is provided to impart torque or rotational force to rotate the pressure roller 31, which in turn rotates the fuser belt 21 to advance a recording sheet S through the fixing nip N. Inside the heat pipe 22 is a stationary, reinforcing member 23 that reinforces the fuser pad 26 where the pressure roller 31 presses against the fuser pad 26. A thermometer or thermistor 40 is disposed facing an outer surface of the fuser belt 21 to detect the belt temperature for control of power supply to the heater 25.

Components of the fixing device 20 recited herein above, including the heat pipe 22, the fuser belt 21, the heater 25, the fuser pad 26, and the pressure roller 31, all extend in an axial, longitudinal direction X between a pair of sidewalls 43 that constitute a frame of the fixing device 20.

During operation, the fixing device 20 activates the rotary drive motor 60 and the heater 25 as the image forming apparatus 1 is powered up. Upon activation, the heater 25 starts radiating heat to the heat pipe 22, which then conducts heat to the fuser belt 21 to heat it to a desired operational temperature. At the same time, the motor-driven pressure roller 31 starts rotation clockwise in FIG. 2 in frictional contact with the fuser belt 21, which in turn rotates around the heat pipe 22 counterclockwise in FIG. 2.

Then, a recording sheet S bearing an unfixed, powder toner image T thereon enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10 perpendicular to the axial direction X, substantially flat and erect along a guide plate, not shown, disposed along the sheet conveyance path.

At the fixing nip N, the fuser belt 21 heats the incoming sheet S to fuse and melt the toner particles T, while the pressure roller 31 presses the sheet S against the fuser pad 26 to cause the molten toner T to settle onto the sheet surface. As the toner image T is thus fixed in place through the fixing nip N, the recording sheet S is forwarded to exit the fixing device 20 in the direction of arrow Y11.

In the present embodiment, the fuser belt 21 comprises a thin, multi-layered, looped flexible belt with a thickness of approximately 1 mm or less and a diameter ranging from approximately 15 mm to approximately 120 mm in its generally cylindrical, looped configuration (with an inner diameter of about 30 mm in the present embodiment), the overall length of which is formed of a substrate covered with an intermediate elastic layer and an outer release coating deposited thereon, one atop another.

Specifically, the substrate of the fuser belt 21 may be a layer of metal or resin, such as nickel, stainless steel, polyimide, or the like, approximately 30 μm to approximately 50 μm thick. The intermediate elastic layer may be a deposit of rubber, such as solid or foamed silicone rubber, fluorine resin, or the like, approximately 100 μm to approximately 300 μm thick. The outer coating may be a deposit of a release agent, such as tetrafluoroethylene-perfluoro alkylvinyl ether copolymer (PFA), polytetrafluoroethylene (PTFE), polyimide (PI), polyetherimide (PEI), polyethersulfide (PES), or the like, approximately 10 μm to approximately 50 μm thick.

The intermediate elastic layer of the fuser belt 21 serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

Figure 4:
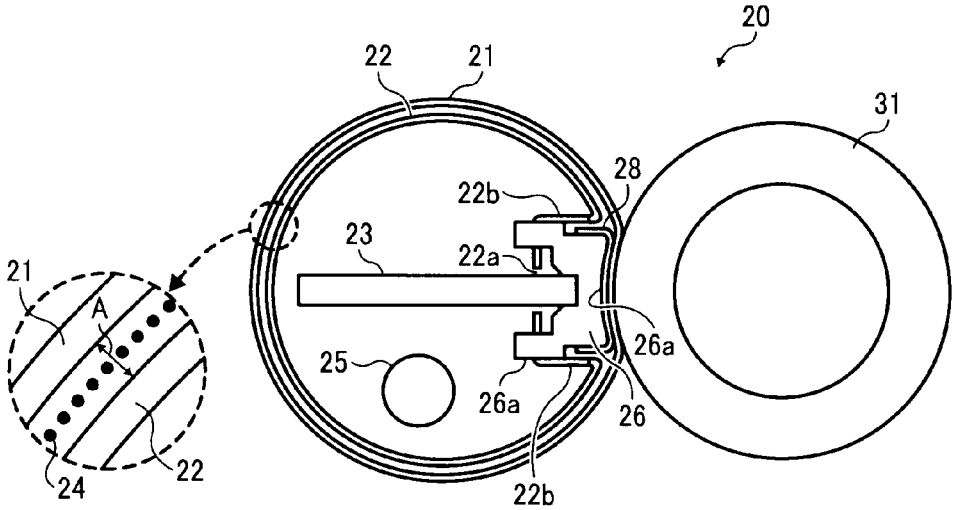
FIG. 4 is another, detailed axial end-on view of the fixing device of FIG. 2.

With additional reference to FIG. 4, which is another, detailed axial end-on view of the fixing device 20, the fixing device 20 is shown with the reinforcing member 23, the heater 25, and the fuser pad 26 disposed stationary inside the loop of the fuser belt 21 entrained around the heat pipe 22.

In the present embodiment, the fuser pad 26 comprises an elongated piece of heat-resistant resin, such as liquid crystal polymer (LCD) or the like. A lubricant 28 shaped in a thin rectangular strip of anti-abrasive, heat-resistant material that exhibits a small coefficient of friction against the fuser belt 21, such as a web of porous fluorine resin, is disposed between the fuser pad 26 and the fuser belt 21 to reduce frictional resistance therebetween. The fuser pad 26 has its opposed longitudinal ends secured to the sidewalls 43 of the fixing device 20.

Specifically, the fuser pad 26 has a slidable contact surface **26*a* defined on its front side to face the pressure roller 31. In this embodiment, the slidable contact surface 26*a* of the fuser pad 26 is slightly concave with a curvature similar to that of the circumference of the pressure roller 31. Such a configuration allows the contact surface 26***a* to readily conform to the circumferential surface of the pressure roller 31, which prevents the recording sheet S from adhering to or winding around the fuser belt 21 upon exiting the fixing nip N, leading to reliable conveyance of the recording sheet S after fixing process.

Alternatively, instead of the curved configuration, the slidable contact surface 26*a* of the fuser pad 26 may be substantially flat. Such a configuration causes the contact surface 26*a* to parallel the printed side of the recording sheet S, which can then remain straight and closely contact the fuser belt 21 within the fixing nip N. Close contact thus established between the recording sheet S and the fuser belt 21 allows good fusing performance owing to efficient, uniform heating of the recording sheet S, while allowing for good stripping of the recording sheet S from the fuser belt 21 which exhibits a curvature larger at the exit of the fixing nip N than within the fixing nip N.

The fuser pad 26 is positioned at least in a direction in which the recording sheet S is conveyed through the fixing nip N by securing its longitudinal ends to the sidewalls 43 of the fixing device 20. Additionally, the fuser pad 26 may also be positioned in a direction in which the pressure roller 31 presses against the fuser pad 26 by engaging the stationary, reinforcing member 23. A more detailed configuration of the fuser pad 26 and its associated structure will be described later with reference to FIG. 6 and subsequent drawings.

The heat pipe 22 comprises a thermally conductive tubular member formed of a sheet of metal bent into a generally cylindrical configuration with a pair of opposed longitudinal edges thereof folded inward and spaced apart from each other to define a concave, longitudinal side slot 22*a* therebetween. The heat pipe 22 is inserted into the loop of the fuser belt 21 while accommodating the fuser pad 26 in its longitudinal side slot 22*a*, so that an outer circumferential surface of the heat pipe 22 adjoins an inner circumferential surface of the fuser belt 21 except at the fixing nip N in the assembled fixing device 20. The heat pipe 22 has its opposed longitudinal ends secured to the sidewalls 43 of the fixing device 20.

Specifically, the heat pipe 22 may be a tubular piece of sheet metal with a thickness equal to or smaller than approximately 0.2 mm. Examples of sheet metal suitable for obtaining the heat pipe 22 include, but are not limited to, aluminum, iron, stainless steel, and any metal that exhibits a sufficient thermal conductivity for heating the fuser belt 21 entrained therearound. In particular, forming the heat pipe 22 of a 0.2-mm or thinner metal sheet enables efficient heating of the fuser belt 21.

More specifically, in this embodiment, the heat pipe 22 is configured as a bent sheet of stainless steel approximately 0.1 mm thick formed into a generally cylindrical configuration with a substantially circular, C-shaped cross section. Alternatively, instead of a substantially circular cross section, the heat pipe 22 may be configured with a non-circular cross section, such as a polygonal shape or any complex shape formed by combination of circular and rectangular elements.

The heater 25 comprises an elongated, radiant heating element, such as a halogen heater or carbon heater, which radiates heat energy to the fuser assembly. In the present embodiment, the heater 25 is a radiant heater accommodated inside the heat pipe 22. The heater 25 may extend substantially the entire length of the fuser pad 26, and is positioned stationary with its opposed longitudinal ends secured to the sidewalls 43 of the fixing device 20.

To warm up the fixing device 20, the heater 25 radiates heat to the inner circumferential surface of the heat pipe 22. The heat pipe 22, thus heated directly and internally through radiation, in turn imparts heat to the fuser belt 21 entrained therearound except at the fixing nip N at which the outer circumferential surface of the heat pipe 22 does not adjoin the inner circumferential surface of the fuser belt 21. Such indirect heating of the fuser belt 21 via the internally radiated, thermally conductive pipe 22 equalizes heat across the fuser belt 21 rotating around the heat pipe 22, from which heat is uniformly applied to the recording sheet S passing through the fusing nip N, thereby fusing and melting toner. Operation of the heater 25 is controlled by regulating a power supply to the respective heaters 25 according to readings of the thermometer 40 sensing temperatures of the outer circumferential surface of the fuser belt 21 to maintain the belt surface at a desired operational temperature.

Thus, the fuser belt 21 has its entire length heated substantially continuously and uniformly by conduction from the heat pipe 22 being internally heated through radiation with the heater 25. Compared to directly and locally heating only a limited, specific portion of a fuser member, such indirect continuous heating through the heat pipe 22 can warm up the entire length of the fuser belt 21 swiftly and efficiently with a relatively simple configuration, which allows the fixing device 20 to operate at higher processing speeds without causing image defects due to insufficient heating through the fixing nip N. This arrangement leads to a reduction in warm-up time and first-print time required for completing an initial print job upon startup, while allowing for a compact size of the image forming apparatus 1 incorporating the fixing device 20.

With continued reference to FIG. 4, there is shown a gap or clearance A provided between the inner circumferential surface of the fuser belt 21 and the outer circumferential surface of the heat pipe 22 except at the fixing nip N where the fuser pad 26 is disposed. In the present embodiment, the heat pipe 22 and the fuser belt 21 are positioned in close proximity with each other, so that the gap A is kept within an adequate range equal to or smaller than 1 mm.

Providing the gap A between the adjoining circumferential surfaces of the fuser belt 21 and the heat pipe 22 prevents premature failure due to accelerated abrasion of the fuser belt 21 caused by an increased area of sliding contact between the pipe and belt circumferential surfaces. Moreover, keeping the gap A within an adequate range ensures efficient heat transfer from the heat pipe 22 to the fuser belt 21, which prevents imaging failure caused by insufficient heating through the fixing nip N. Further, positioning the fuser belt 21 in close proximity with the heat pipe 22 allows the fuser belt 21 to maintain its generally cylindrical configuration during rotation, so as to prevent damage and failure due to deformation of the elastic belt 21.

Additionally, the fuser belt 21 and the heat pipe 22 may be provided with a lubricating agent 24, such as fluorine grease, deposited between their adjoining circumferential surfaces.

Provision of the lubricant 24 reduces friction at the belt-pipe interface to prevent wear and tear on the fuser belt 21 even when operated in continuous frictional contact with the heat pipe 22. Instead of using the lubricating agent 24, such lubrication may also be accomplished, for example, by forming the outer circumferential surface of the heat pipe 22 of a suitable material that exhibits a low coefficient of friction against the inner circumferential surface of the fuser belt 21, or alternatively, depositing an anti-friction layer of lubricant, such as fluorine-based coating, upon the inner circumferential surface of the fuser belt 21.

The reinforcing member 23 comprises an elongated piece of rigid material sufficiently durable to reinforce and support the fuser pad 26 against nip pressure. The reinforcing member 23 extends substantially the entire length of the fuser pad 26, and is positioned stationary with its opposed longitudinal ends secured to the sidewalls 43 of the fixing device 20.

Specifically, the reinforcing member 23 may be formed of metal, such as iron, stainless steel, or the like, which provides sufficient strength and rigidity to support the fuser pad 26 against pressure transmitted from the pressure roller 31 through the fuser belt 21 and the lubricant 28 interposed between the belt 21 and the pad 26, so as to prevent undesired deformation or bending of the fuser pad 26 under stress from the pressure roller 31.

Optionally, the reinforcing member 23 may be insulated against radiation of heat entirely or partially where it faces the heater 25. Such insulation may be accomplished, for example, by covering the reinforcing member 23 with an insulation member, or alternatively, by processing the reinforcing member 23 through suitable surface treatment, such as bright annealing (BA) or mirror polishing. Insulating the reinforcing member 23 prevents heat loss through dissipation and in turn promotes absorption of heat into the heat pipe 22, leading to good thermal efficiency in heating the fuser belt 21 through conduction from the heat pipe 22.

With continued reference to FIGS. 2 and 3, the pressure roller 31 comprises a motor-driven rotatable cylindrical body approximately 30 mm in diameter, formed of a hollow, cylindrical metal core 32 covered with an outer elastic layer 33. The pressure roller 31 has its opposed longitudinal ends rotatably held on the sidewalls 43 via a pair of bearings 42, one of which is connected to the rotary drive motor 60, via a gear train 45 outside the sidewalls 43 for imparting a rotational force or torque to the roller 31. Optionally, the pressure roller 31 may have a dedicated heating element, such as a halogen heater, within the interior of the hollow roller core 32. Also, an additional coating of a release agent, such as PFA, PTFE, or the like, may be deposited on the outer elastic layer 33.

Specifically, the outer layer 33 of the pressure roller 31 is formed of a suitable elastic material, such as silicone rubber, fluorine rubber, or the like, and preferably, a sponged elastic material, such as foamed silicone rubber. Forming the outer elastic layer 33 with sponged material prevents excessive nip pressure, which would otherwise cause the heat pipe 22 to substantially bend away from the pressure roller 31 at the fixing nip N. Also, covering the heat roller 31 with elastic sponge provides favorable thermal insulation to prevent heat transfer from the fuser belt 21 to the pressure roller 31 at the fixing nip N, leading to enhanced heating efficiency in the fixing device 20.

Although the fuser belt 21 and the pressure roller 31 are of a substantially identical diameter in the embodiment depicted in FIGS. 2 and 3, instead, it is possible to provide the cylindrical fixing members 21 and 31 with different diameters. For example, it is possible to form the fuser belt 21 with a diameter smaller than that of the pressure roller 31, so that the fuser belt 21 exhibits a greater curvature than that of the pressure roller 31 at the fixing nip N, which effects good stripping of a recording sheet from the fuser belt 21 upon exiting the fixing nip N. Alternatively, instead, it is also possible to form the fuser belt 21 with a diameter greater than that of the pressure roller 31. In either case, the heat pipe 22 is properly isolated from pressure from the pressure roller 31 irrespective of the diameters of the fuser belt 21 and the pressure roller 31 being employed.

The biasing mechanism 50 of the pressure roller 31 includes a pressure lever 51, a motor-driven eccentric cam 52, and a spring 53, connected to the roller bearing 42 to adjust position of the roller 31 with respect to the fuser assembly to adjust the length or width of the fixing nip N along the sheet conveyance path.

Specifically, the pressure lever 51 has one hinged end provided with a hinge 51*a* and another, free end loaded with the spring 53 connected to the eccentric cam 52 via a spacer, while supporting the rotational axis of the pressure roller 31 via the roller bearing 42 held on an elongated slot defined in the sidewall 43 displaceably with an appropriate allowance for movement. The eccentric cam 52 is driven for rotation by a motor, not shown, to cause the pressure lever 51 to swivel on the hinge 51*a*, which in turn displaces the pressure roller 31 either toward or away from the fuser belt 21.

Such a biasing mechanism 50 enables the fixing device 20 to move the pressure roller 31 into pressure contact with the fuser belt 21 to form a desired fixing nip by setting the eccentric cam 52 to an operating position (i.e., such as one depicted in FIG. 2) upon entering operation, and to retract the pressure roller 31 away from the fuser belt 21 to remove nip pressure by rotating the eccentric cam 52 by 180 degrees from the operating position when out of operation or under maintenance where normal operation is suspended for correcting faults such as paper getting jammed in the fixing nip N.

Figure 5:
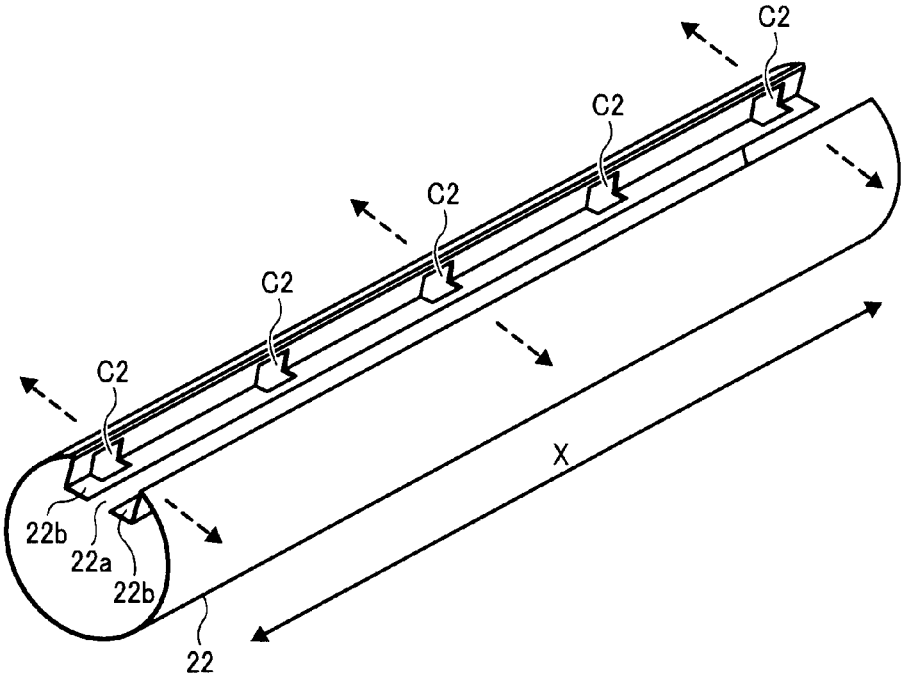
FIG. 5 is a perspective view of a heat pipe included in the fixing device of FIG. 2.

FIG. 5 is a perspective view of the heat pipe 22 included in the fixing device 20.

As shown in FIG. 5, and as mentioned earlier, the heat pipe 22 comprises a thermally conductive, longitudinally slotted tubular pipe formed of a sheet of metal bent into a generally cylindrical configuration with a pair of opposed longitudinal edges 22*b* thereof folded inward and spaced apart from each other to form the concave, longitudinal side slot 22*a* for accommodating the fuser pad 26 therein.

In general, a metal-worked piece produced by bending sheet metal, such as stainless steel, tends to lose some of its desired shape because of an elastic recovery of the bent sheet of metal, known in the art as "springback". For example, in the case of the longitudinally slotted metal tube, the opposed longitudinal edges of the bent metal sheet will gradually separate further from each other, as indicated by broken-line arrows in FIG. 5, resulting in an enlarged gap or opening therebetween which is greater than that originally designed to accommodate the fuser pad therein. If not corrected, such deformation of the heat pipe would result in localized sliding contact between the heat pipe and the fuser belt to accelerate wear and tear of the fuser belt.

To counteract the problem, the heat pipe 22 according to this patent specification is provided with a coupling mechanism C that couples together the pair of opposed longitudinal edges 22*b* of the bent sheet of metal to retain the longitudinally slotted heat pipe 22 in its desired, generally cylindrical configuration. A detailed description of such a coupling mechanism C, associated with specific configurations of the heat pipe 22 and the fuser pad 26, is now given with reference to FIG. 6, and subsequent drawings.

Figure 6:
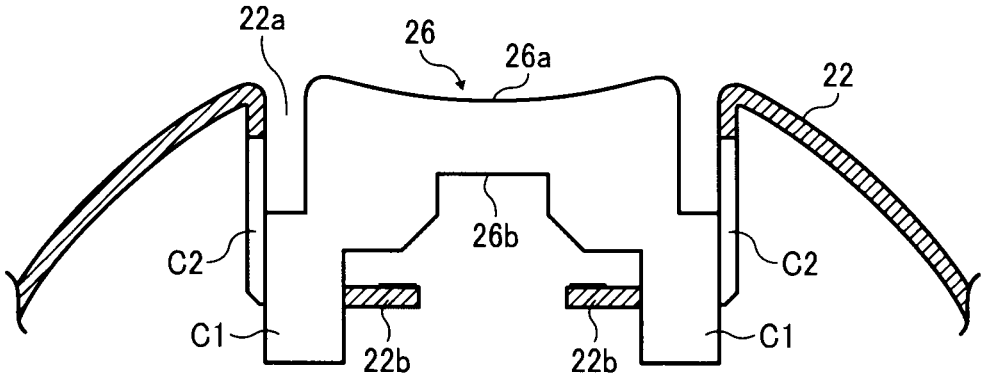
FIG. 6 is an enlarged, partial cross-sectional view of a heat pipe and a fuser pad provided with a coupling mechanism according to one or more embodiments of the present invention.

FIG. 6 is an enlarged, partial cross-sectional view of the heat pipe 22 and the fuser pad 26 provided with the coupling mechanism C according to one or more embodiments of this patent specification.

As shown in FIG. 6, the coupling mechanism C includes a pair of first coupling portions C1 in the fuser pad 26, one on each longitudinal edge of the fuser pad 26, and a pair of second coupling portions C2 in the heat pipe 22, one in each of the pair of opposed longitudinal edges 22*b* of the bent sheet of metal forming the heat pipe 22. The first coupling portion C1 is engageable with the second coupling portion C2 to couple together the pair of opposed longitudinal edges 22*b* to retain the heat pipe 22 in the generally cylindrical configuration.

Figure 7:
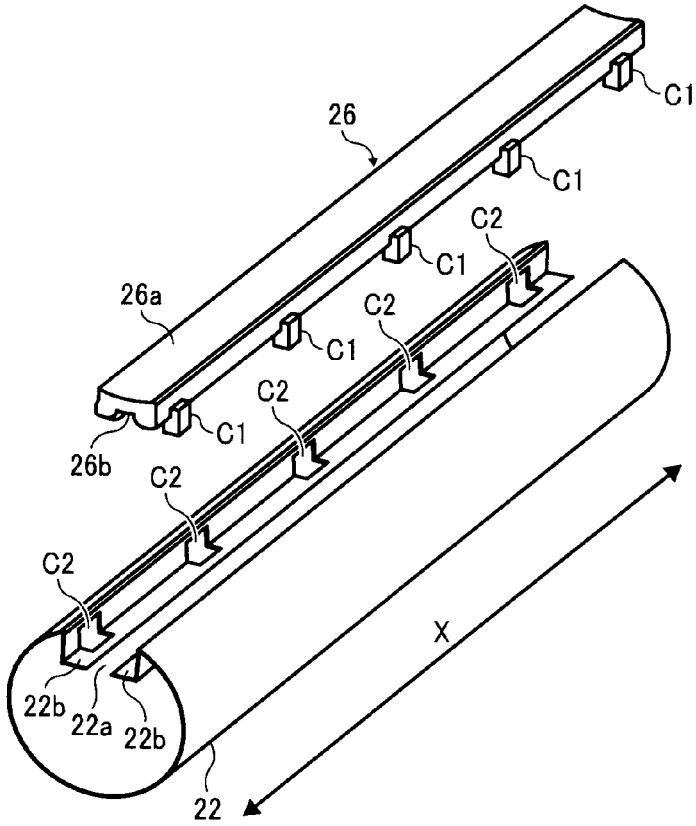
FIG. 7 is an exploded perspective view of the heat pipe and the fuser pad of FIG. 6.

Specifically, with additional reference to FIG. 7, which is an exploded perspective view of the heat pipe 22 and the fuser pad 26, the pair of first coupling portions C1 (of which only one is visible in the view) each includes one or more protrusions extending outward from a side of the fuser pad 26, and the pair of second coupling portions C2 (of which only one is visible in the view) each includes one or more openings defined in the longitudinal edge 22*b* of the heat pipe 22 to engage the protrusions C1 as the fuser pad 26 is accommodated in the longitudinal slot 22*a* of the heat pipe 22.

More specifically, in the present embodiment, each first coupling portion C1 includes a plurality of (e.g., five, in this case) protrusions arranged along the fuser pad 26 in the axial, longitudinal direction X, and each second coupling portion C2 includes a plurality of openings (e.g., five, in this case) arranged along the heat pipe 22 in the axial, longitudinal direction X, with each of the plurality of protrusions C1 engaging an associated one of the plurality of openings C2 as the fuser pad 26 is accommodated in the longitudinal slot 22*a* of the heat pipe 22. Those protrusions C1 and openings C2 may be spaced equidistantly apart along the edges of the fuser pad 26 and the edges of the heat pipe 22, respectively.

In such a configuration, even where the opposed longitudinal edges 22*b* of the heat pipe 22 tend to separate from each other upon assembly, such separating tendency is restrained as the adjoining portions of the engageable protrusion and opening C1 and C2 bear against each other to establish or strengthen engagement therebetween, thereby coupling the pair of opposed longitudinal edges 22*b* together with the fuser pad 26 accommodated in the longitudinal side slot 22*a*.

Thus, provision of the coupling mechanism C effectively prevents undesired separation of the opposed edges 22*b* of the longitudinally slotted heat pipe 22, which, if present at any part of the elongated pipe 22, would eventually accelerate wear and tear of the fuser belt 21 due to an enlarged area of sliding contact between the belt and pipe circumferential surfaces. More reliable protection against deformation of the heat pipe 22 may be provided by deploying the plurality of engageable protrusions and openings C1 and C2 in the axial, longitudinal direction X of the fuser pad 26 and the heat pipe 22, which effectively prevents partial, irregular deformation and uneven widening of the longitudinal side slot 22*a*.

With continued reference to FIG. 6, the fuser pad 26 is shown with its stationary contact surface 26*b* defined on a rear side thereof (i.e., opposite the front side on which the slidable contact surface 26*a* is defined) to contact the reinforcing member 23. In the present embodiment, the stationary contact surface 26*b* of the fuser pad 26 is recessed to engage the reinforcing member 23, and extends across an entire length of the fuser pad 26 to encompass at least a maximum width of a recording sheet S accommodated through the fixing nip N.

Provision of the stationary contact surface 26*b* causes the fuser pad 26 to receive pressure from the pressure roller 31 entirely and uniformly at least along the maximum compatible width of recording sheet S. Such uniform dispersion of pressure on the fuser pad 26 leads to good imaging performance of the fixing device 20, as it effectively prevents a localized reduction in pressure across the fixing nip N, compared to a configuration where the fuser pad contacts the reinforcing member only partially and intermittently along its longitudinal dimension, resulting in image defects due to insufficient pressure through the fixing nip N.

Also, engaging the contact surface 26*b* with the reinforcing member 23 allows the entire length of the fuser pad 26 to be stationarily supported by the reinforcing member 23, which is in turn supported by the frame or sidewalls 43 of the fixing device 20. Such stationary support of the fuser pad 26 eventually protects the fuser pad 26 from deformation and displacement due to torque transmitted from the pressure roller 31 through the fuser belt 21 sliding against the stationary fuser pad 26 as the motor-driven pressure roller 31 rotates.

With still continued reference to FIG. 6, the fuser pad 26 and the heat pipe 22 are shown contacting each other only where the first and second coupling portions C1 and C2 engage each other. That is, the fuser pad 26 is inserted into the longitudinal side slot 22*a* of the heat pipe 22 with a space or clearance left between the adjoining surfaces of the fuser pad 26 and the heat pipe 22, except where the adjoining surfaces of the engageable protrusion and opening C1 and C2 contact each other.

Spacing between the fuser pad 26 and the heat pipe 22 isolates the heat pipe 22 from pressure exerted on the fuser pad 26 from the pressure roller 31, so as to protect the heat pipe 22 against deformation or bending due to nip pressure during operation, which would adversely affect fixing performance due to variations in pressure across the fixing nip N. This is particularly true where the heat pipe 22 is formed of an extremely thin plate of stainless steel or other conductive material to reduce heat capacity of the fuser assembly for shortening the warm-up time of the fixing device, which, however, can compromise structural rigidity of the heat pipe, making it susceptible to pressure from the pressure member.

Figure 8A:
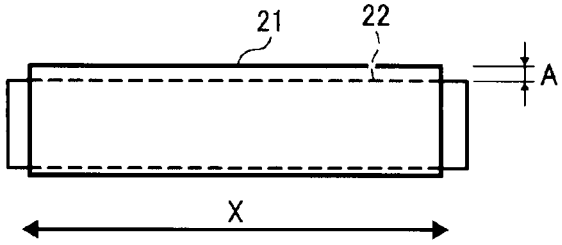
FIGS. 8A and 8B are schematic illustrations of behavior of a heat pipe and a fuser belt at a normal, room temperature and at an elevated, operational temperature, respectively.
Figure 8B:
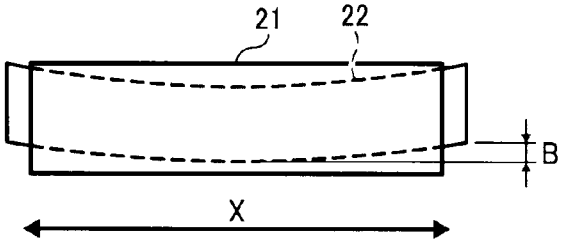

FIGS. 8A and 8B are schematic illustrations of behaviour of the heat pipe 22 and the fuser belt 21 at a normal, room temperature and at an elevated, operational temperature, respectively.

As shown in FIG. 8A, where the fuser assembly is at the normal temperature, the heat pipe 22 remains in its straight cylindrical configuration, leaving a certain regular amount of gap or clearance A between the adjoining surfaces of the heat pipe 22 and the fuser belt 21, which is substantially uniform in the longitudinal direction X.

As shown in FIG. 8B, where the fuser assembly is heated to an operational temperature of, for example, 140° C. to 180° C., the heat pipe 22 bows or radially deforms by an amount B from its original shape, resulting in concomitant variations in the clearance A, due to a relatively large temperature gradient along the thickness of the sheet metal causing spatial variations in thermal expansion across the heat pipe 22.

Such radial deformation of the heat pipe 22 is reversible insofar as the stress placed on the heat pipe 22 is not large enough to cause plastic deformation of the pipe material. That is, as the fuser assembly cools to the room temperature, the heat pipe 22 returns to its original, straight cylindrical shape with the original, regular amount of clearance A restored between the adjoining surfaces of the heat pipe 22 and the fuser belt 21.

The amount of deformation B experienced by the heat pipe 22, which is dependent on temperature gradient along the thickness of the pipe material, changes with time as the fuser assembly is subjected to heating during operation of the fixing device 20.

For example, during warm-up where the fuser assembly is rapidly heated to an operational temperature of 140° C. to 180° C. from a normal or quasi-normal temperature, the outer circumferential surface of the heat pipe 22 remains colder than the inner circumferential surface of the heat pipe 22, as the former is further than the latter from the heater 25 situated inside the heat pipe 22, so that the temperature distribution within the heat pipe 22 is uneven, in particular, immediately after activation of the heater. Rapid heating of the fuser assembly thus causes a relatively large temperature gradient along the thickness of the pipe material, resulting in a maximum amount of deformation Bmax experienced by the heat pipe 22.

As the fuser assembly gradually cools and stabilizes at a desired operational temperature upon completion of warm-up, the temperature distribution within the heat pipe 22 becomes even and homogeneous, which translates into a relatively small temperature gradient along the thickness of the pipe material smaller than that observed during warm-up, resulting in a reduced, average amount of deformation Bave experienced by the heat pipe 22.

In the present embodiment, the fuser assembly is designed so that the clearance A, or more precisely, a minimum amount of clearance A, between the fuser belt 21 and the heat pipe 22 at a normal, room temperature exceeds the amount of deformation Bmax of the heat pipe 22 during warm-up, but does not exceed the amount of deformation Bave of the heat pipe 22 upon completion of warm-up, as defined by the following equation:

$$Bave < A \leq Bmax \qquad \text{Equation (1)}$$

Specifically, the fuser assembly is configured with one or more of its physical, geometrical and/or operational factors adjusted to satisfy the above condition Eq. (1). Examples of such parameters include, but are not limited to, the inner diameter of the fuser belt 21 and the outer diameter of the heat pipe 22, which defines the amount of clearance A therebetween, as well as the type and thickness of metal sheet used to produce the heat pipe 22, the type of heater 25, and the operational temperature employed to heat the fuser assembly.

For example, in this embodiment, the heat pipe 22 is configured as a metal tube formed of a 0.1-mm thick sheet of stainless steel, type SUS430 as specified in the Japanese Industrial Standards (JIS), and the heater 25 is operated to heat the fuser assembly at a designed operational temperature of 180° C., resulting in a maximum deformation Bmax of 1.3 mm and an average deformation Bave of 0.4 mm. The fuser belt 21 is dimensioned with an inner diameter of 30 mm, and the heat pipe 22 with an outer diameter of 29.5 mm, yielding a clearance A of approximately 0.5 mm between their adjoining circumferential surfaces, which exceeds the maximum amount of deformation Bmax, but does not exceed the average amount of deformation Bave.

Setting the clearance A equal to or smaller than the maximum deformation Bmax causes the heat pipe 22 to establish close, tight contact with the fuser belt 21 during warm-up, where the belt 21 remains stationary and does not rotate. The gapless contact between the heat pipe 22 and the fuse belt 21 effectively promotes conduction of heat from the heat pipe 22 to the fuser belt 21, resulting in efficient heating of the fuser belt 21 with the internally heated pipe 22, which allows for protection against imaging failure due to insufficient heating of the fuser belt in high-speed applications, as well as shorter warm-up time and first-print time required to heat the fuser belt 21 to the operational temperature than is otherwise possible.

On the other hand, setting the clearance A greater than the average deformation Bave causes the heat pipe 22 to remain slightly apart from, or in an extremely limited, if any, contact with, the inner circumferential surface of the fuser belt 21 as the belt 21 starts rotation upon completion of start-up. The absence or limitation of contact between the heat pipe 22 and the fuser belt 21 effectively prevents the pipe and belt circumferential surfaces from sliding against each other during operation of the fixing device, resulting in high immunity against abrasion of the fuser belt 21 and the heat pipe 22 of the fuser assembly.

Hence, the fixing device in the present embodiment is provided with the clearance A between the fuser belt 21 and the heat pipe 22 at a normal, room temperature optimized relative to the maximum and average amounts of deformation Bmax and Bave, respectively, of the heat pipe 22, the former being measured during warm-up, and the latter upon completion of warm-up. Such optimization of the clearance A enables the fixing device 20 to heat the fuser assembly efficiently and effectively with an extremely short warm-up time and first-print time required to heat the fuser belt, allowing for reliable processing of toner images without defects even at higher processing speeds, while highly immune against abrasion or failure due to undue sliding between the fuser belt 21 and the heat pipe 22 during operation.

Figure 9:
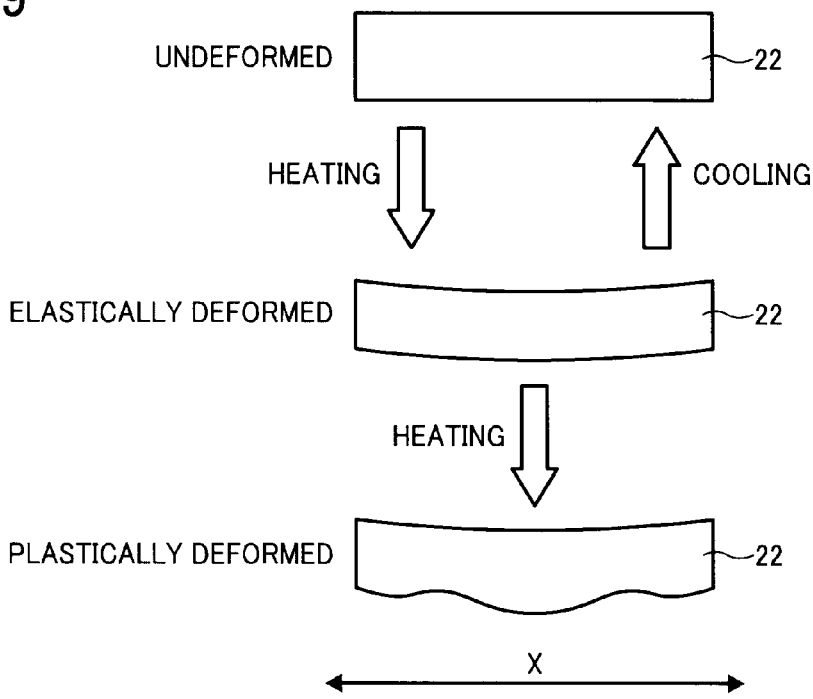
FIG. 9 is a schematic illustration of changes in the shape of a thin-walled heat pipe when subjected to repeated heating and cooling cycles.

FIG. 9 is a schematic illustration of changes in the shape of a thin-walled heat pipe 22 when subjected to repeated heating and cooling cycles.

As shown in FIG. 9, the heat pipe 22, which retains its substantially straight, undeformed configuration at a normal, room temperature ("UNDEFORMED"), elastically deforms into a bowed shape ("ELASTICALLY DEFORMED") upon rapid heating to a higher, operational temperature. The heat pipe 22, once elastically deformed, can regain its original shape when cooled to the room temperature. However, when heated to even higher temperatures after elastic deformation, the heat pipe 22 plastically deforms or buckles into an irregular, undulating shape ("PLASTICALLY DEFORMED"). In contrast to elastic deformation, which can be reversed by lowering the pipe temperature, plastic deformation or buckling is irreversible when excess heat is removed from the heat pipe. Thus, the buckling heat pipe 22 remains deformed even when cooled to the room temperature.

Such plastic deformation of the heat pipe, if taking place during operation, would adversely affect performance and durability of the fixing device. For example, irregularities on the heat pipe translate into a localized, concentrated contact between the heat pipe and the fuser belt, which causes abrasion and eventual failure where the heat pipe strikes against the fuser belt. Localized contact between the heat pipe and the fuser belt can also cause variations in temperature of the fuser belt, leading to insufficient fixing or variations in gloss of resulting images. Those problems associated with thermally induced, irreversible deformation of the heat pipe tend to occur particularly in a configuration that employs an extremely thin-walled tube of sheet metal with a thickness of 0.1 mm or less for obtaining a reduced heat capacity and increased heating efficiency of the heat pipe.

The inventors have recognized that susceptibility of the heat pipe to irreversible plastic deformation is dependent on the hardness of the material of which the tubular heat pipe is formed. That is, too hard a pipe material results in reduced resistance to thermal stress, and thus, a high susceptibility to plastic deformation of the heat pipe. A relatively soft pipe material, by contrast, allows for a high capability of the heat pipe to elastically regain its original shape from thermally-induced deformation, resulting in a low susceptibility to plastic deformation of the heat pipe.

To obtain good heating efficiency as well as effective protection against plastic deformation or buckling of the thin-walled metal tube, in the present embodiment, the heat pipe 22 is configured as a tubular piece of sheet metal that has a thickness of approximately 0.2 mm or less, preferably, approximately 0.1 mm or less, and exhibits a Vickers hardness not exceeding approximately 280 HV.

Specifically, the heat pipe 22 may be formed of ferritic stainless steel with a relatively small volumetric heat capacity, for example, type SUS430 as specified in the JIS, which exhibits a density of $7.73*10^{-3}$ kg/m$^3$, a heat capacity of 0.46 kJ/(kg*° C.), a Young's modulus of 206 GPa, a volumetric heat capacity of 3.56, and a Vicker's hardness of 250 HV.

Other examples of material which exhibits a relatively small Vicker's hardness include nickel and austentic stainless steel. For example, nickel exhibits a density of $8.9*10^{-3}$ kg/m$^3$, a heat capacity of 0.439 kJ/(kg*° C.), a Young's modulus of 210 GPa, a volumetric heat capacity of 3.91, and a Vicker's hardness of 96 HV. Austentic stainless nickel, type SUS304-1/2H as specified in the JIS, exhibits a density of $7.93*10^{-3}$ kg/m$^3$, a heat capacity of 0.502 kJ/(kg*° C.), a Young's modulus of 197 GPa, a volumetric heat capacity of 3.98, and a Vicker's hardness of 250 HV.

Experiments have been conducted to investigate the relation between Vicker's hardness of the pipe material and susceptibility of the heat pipe to plastic deformation. In the experiments, several types of heat pipes were prepared, each formed of a 0.1-mm thick piece of metal sheet with a particular Vicker's hardness, around which was entrained a metal-based fuser belt, formed of a 35-μm thick nickel substrate, a 200-μm thick intermediate layer of silicone rubber, and a 15-μm thick outer coating of PFA deposited one upon another. These heat pipes were subjected to rapid heating to different temperatures. After heating, each experimental sample was examined for plastic deformation or buckling of the heat pipe.

Figure 10:
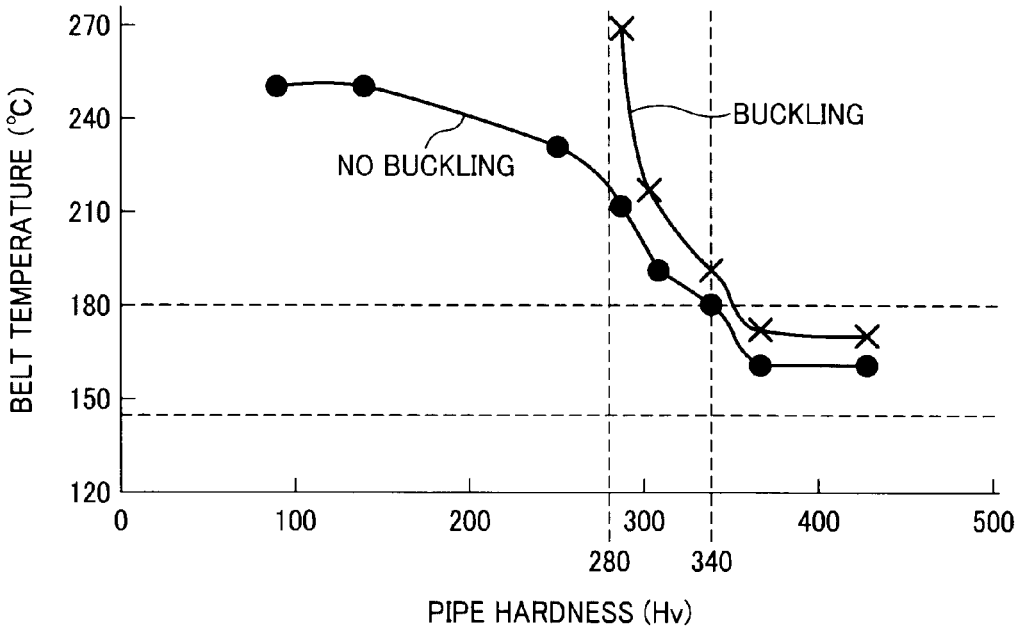
FIG. 10 shows results of experiments conducted to investigate the relation between Vicker's hardness of pipe material and susceptibility of the heat pipe to plastic deformation.

Results of such experiments are shown in FIG. 10, in which graphs labeled "NO BUCKLING" and "BUCKLING" both plot temperature, in ° C., of the fuser belt against hardness, in HV, of the heat pipe, the former for the samples that did not plastically deform, and the latter for the samples that experienced plastic deformation.

As shown in FIG. 10, with a hardness falling below 280 HV, no heat pipe underwent an irreversible, plastic deformation even when rapidly heated to temperatures well above a normal operational temperature range of between 140° C. and 180° C. By contrast, the heat pipes with a hardness exceeding 280 HV, in particular, those with a hardness exceeding 340 HV, exhibited higher susceptibility to plastic deformation. For example, the sample with a pipe hardness of approximately 300 HV plastically deformed upon rapid heating to 210° C., although remained free from buckling upon rapid heating to 190° C.

The experimental results demonstrate high resistance against thermally induced deformation of the heat pipe with a Vicker's hardness not exceeding approximately 280 HV, which escaped plastic deformation or buckling upon rapid heating to temperatures well beyond the normal operational temperature range. Also demonstrated is that setting the operational temperature of the fixing process to equal to or below 180° C. effectively prevents plastic deformation of the heat pipe with a Vicker's hardness ranging from 280 HV to 340 HV.

To recapitulate, the fixing device 20 according to one or more embodiments of this patent specification includes a tubular heat pipe 22 formed of a sheet of metal bent into a generally cylindrical configuration with a pair of opposed longitudinal edges 22*b* thereof spaced apart from each other to define a longitudinal slot 22*a* therebetween; a rotatable, flexible fuser belt 21 looped for rotation around the heat pipe 22, with variable clearance between the inner surface of the fuser belt 21 and the outer surface of the heat pipe 22; a heater 25 disposed within the heat pipe 22 to heat the heat pipe 22 to conduct heat to the fuser belt 21; an elongated, stationary fuser pad 26 accommodated in the longitudinal slot 22*a* of the heat pipe 22 inside the loop of the fuser belt 21; and a rotatably driven pressure member 31 disposed parallel to the heat pipe 22 with the fuser belt 21 interposed between the fuser pad 26 and the pressure member 31. The pressure member 31 presses against the fuser pad 26 through the fuser belt 21 to form a fixing nip N therebetween, through which a recording medium S is conveyed under heat and pressure as the pressure member 31 rotates to in turn rotate the fuser belt 21.

Such a fixing device 20 is provided with a coupling mechanism C including a pair of first coupling portions C1 in the fuser pad 26, one on each longitudinal edge of the fuser pad 26; and a pair of second coupling portions C2 in the heat pipe 22, one in each of the pair of opposed longitudinal edges 22*b* of the bent sheet of metal. The first coupling portion C1 is engageable with the second coupling portion C2 to couple together the pair of opposed longitudinal edges 22*b* to retain the heat pipe 22 in the generally cylindrical configuration.

Provision of the coupling mechanism C prevents undesired separation or displacement of the opposed longitudinal edges 22*b* of the bent sheet of metal forming the heat pipe 22, thereby retaining the heat pipe 22 in its original, generally cylindrical configuration. Such protection against deformation of the heat pipe 22 eventually prevents the heat pipe 22 and the fuser belt 21 from unduly sliding against each other, which would otherwise result in premature failure of the fuser assembly due to accelerated abrasion of the fuser belt. Also, maintaining the proper configuration of the heat pipe 22 allows for thorough, uniform heating in the circumferential direction across the fuser belt 21, leading to reliable performance free from imaging defects due to partial, localized or concentrated heating of the fuser belt even at higher processing speeds of the fixing device. Moreover, compared to a separate, dedicated fastener or connecting device, the coupling mechanism C formed in the fuser pad 26 and the heat pipe 22 to couple together the opposed longitudinal edges of the heat pipe 22 does not require a costly, complicated assembly process involving various components and subassemblies, and therefore allows for an inexpensive configuration of the fixing device 20.

According to further embodiments of this patent specification, each first coupling portion C1 includes one or more protrusions extending outward from a side of the fuser pad 26, and each second coupling portion C2 includes one or more openings defined in the longitudinal edge 22*b* of the heat pipe 22 to engage the protrusions as the fuser pad 26 is accommodated in the longitudinal slot 22*a* of the heat pipe 22.

The coupling mechanism C established through engagement between the protrusions C1 in the fuser pad 26 and the openings C2 in the heat pipe 22 effectively prevents undesired separation or displacement of the opposed longitudinal edges 22*b* of the heat pipe 22, wherein the tendency of the opposed longitudinal edges 22*b* to separate from each other upon assembly is restrained as the adjoining portions of the engageable protrusion and opening C1 and C2 bear against each other to establish or strengthen engagement therebetween, thereby coupling the pair of opposed longitudinal edges 22*b* together with the fuser pad 26 accommodated in the longitudinal side slot 22*a*.

According to still further embodiments of this patent specification, each first coupling portion C1 includes a plurality of protrusions arranged along the fuser pad 26 in an axial, longitudinal direction X thereof, and each second coupling portion C2 includes a plurality of openings arranged along the heat pipe 22 in an axial, longitudinal direction X thereof, with each of the plurality of protrusions engaging an associated one of the plurality of openings as the fuser pad 26 is accommodated in the longitudinal slot 22*a* of the heat pipe 22.

Providing the plurality of longitudinally arranged openings in the heat pipe 22 and the plurality of longitudinally arranged protrusions in the fuser pad 26 enables the coupling mechanism C to reliably maintain the original, generally cylindrical configuration along the entire length of the heat pipe 22, which ensures that the heat pipe 22 heats the fuser belt 21 thoroughly and uniformly in the rotational, circumferential direction, leading to reliable performance free from imaging defects due to partial, localized or concentrated heating of the fuser belt even at higher processing speeds of the fixing device.

According to still further embodiments of this patent specification, the fuser pad 26 and the heat pipe 22 are spaced apart from each other except where the first and second coupling portions C1 and C2 engage each other.

Spacing between the fuser pad 26 and the heat pipe 22 effectively isolates the thin-walled metal pipe 22 from pressure from the pressure roller 31, thereby preventing the heat pipe 22 from deformation under nip pressure, which would otherwise result in variations in the fixing nip N and concomitant defective performance of the fixing device.

According to still further embodiment of this patent specification, the fuser pad 26 is formed of heat-resistant resin.

Such arrangement contributes to designing the thermally-efficient, fast stable fixing device 20, which can heat the fuser assembly efficiently and effectively with an extremely short warm-up time and first-print time required to heat the fuser belt, allowing for reliable processing of toner images without defects even at higher processing speeds, while highly immune against abrasion or failure due to undue sliding between the fuser belt 21 and the heat pipe 22 during operation.

According to still further embodiments of this patent specification, the heat pipe 22 comprises a tubular piece of sheet metal having a thickness equal to or smaller than approximately 0.2 mm.

Such arrangement increases thermal efficiency in heating the fuser belt 21 with the heat pipe 22, so that the fixing device 20 can heat the fuser assembly efficiently and effectively with an extremely short warm-up time and first-print time required to heat the fuser belt, allowing for reliable processing of toner images without defects even at higher processing speeds, while highly immune against abrasion or failure due to undue sliding of the fuser belt 21 against the heat pipe 22 during operation.

According to still further embodiments of this patent specification, the heat pipe 22 the heat pipe comprises a tubular piece of sheet metal that exhibits a Vicker's hardness not exceeding 280 HV.

Such arrangement effectively prevents the heat pipe 22 from plastic deformation or buckling irrespective of the operational temperature of the fixing process, so that the fixing device 20 can heat the fuser assembly efficiently and effectively with an extremely short warm-up time and first-print time required to heat the fuser belt, allowing for reliable processing of toner images without defects even at higher processing speeds, while highly immune against abrasion or failure due to undue sliding between the fuser belt 21 and the heat pipe 22 during operation.

According to still further embodiment of this patent specification, the heat pipe 22 is formed of ferritic stainless steel.

Such arrangement effectively prevents the heat pipe 22 from plastic deformation or buckling while increasing thermal efficiency in heating the heat pipe 22, so that the fixing device 20 can heat the fuser assembly efficiently and effectively with an extremely short warm-up time and first-print time required to heat the fuser belt, allowing for reliable processing of toner images without defects even at higher processing speeds, while highly immune against abrasion or failure due to undue sliding between the fuser belt 21 and the heat pipe 22 during operation.

According to yet still further embodiments of this patent specification, the fixing device 20 includes a reinforcing member 23 disposed inside the loop of the fuser belt 21 to reinforce the fuser pad 26 against pressure from the pressure member 31, wherein the fuser pad 26 has a contact surface 26*b* defined on a rear side thereof to contact the reinforcing member 23, which encompasses at least a maximum width of a recording medium S accommodated through the fixing nip N.

Provision of the reinforcing member 23 contacted by the fuser pad 26 across at least the maximum compatible width of recording medium S not only prevents a localized reduction in nip pressure as well as deformation or displacement of the fuser pad 26 due to transmitted torque from the pressure roller 31, but also maintains the proper configuration of the heat pipe 22, which allows for thorough, uniform heating in the circumferential direction across the fuser belt 21, leading to reliable performance free from imaging defects due to partial, localized or concentrated heating of the fuser belt even at higher processing speeds of the fixing device.

The image forming apparatus 1 incorporating the fixing device 20 according to one or more embodiments of this patent specification benefits from those and other effects of the fixing device 20.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a tubular heat pipe formed of a sheet of metal bent into a generally cylindrical configuration, with a pair of opposed longitudinal edges thereof spaced apart from each other to define a longitudinal slot therebetween;

a rotatable, flexible fuser belt looped for rotation around the heat pipe, with variable clearance between the inner surface of the fuser belt and the outer surface of the heat pipe;

a heater disposed within the heat pipe to heat the heat pipe to conduct heat to the fuser belt;

an elongated, stationary fuser pad accommodated in the longitudinal slot of the heat pipe inside the loop of the fuser belt;

a rotatably driven pressure member disposed parallel to the heat pipe with the fuser belt interposed between the fuser pad and the pressure member, the pressure member pressing against the fuser pad through the fuser belt to form a fixing nip therebetween, through which a recording medium is conveyed under heat and pressure; and a coupling mechanism comprising:

a pair of first coupling portions in the fuser pad, one on each longitudinal edge of the fuser pad; and a pair of second coupling portions in the heat pipe, one in each of the pair of opposed longitudinal edges of the bent sheet of metal, the first coupling portion engageable with the second coupling portion to couple together the pair of opposed longitudinal edges to retain the heat pipe in the generally cylindrical configuration, wherein a minimum clearance between the fuser belt and the heat pipe at a normal, room temperature exceeds an amount of deformation of the heat pipe during warm-up, but does not exceed an amount of deformation of the heat pipe upon completion of warm-up.

2. The fixing device according to claim 1, wherein each first coupling portion includes one or more protrusions extending outward from a side of the fuser pad, and each second coupling portion includes one or more openings defined in the longitudinal edge of the heat pipe to engage the protrusions as the fuser pad is accommodated in the longitudinal slot of the heat pipe.

3. The fixing device according to claim 2, wherein each first coupling portion includes a plurality of protrusions arranged along the fuser pad in an axial, longitudinal direction thereof, and each second coupling portion includes a plurality of openings arranged along the heat pipe in an axial, longitudinal direction thereof, with each of the plurality of protrusions engaging an associated one of the plurality of openings as the fuser pad is accommodated in the longitudinal slot of the heat pipe.

4. The fixing device according to claim 3, wherein the protrusions and the openings are spaced equidistantly apart along the edges of the fuser pad and the edges of the heat pipe, respectively.

5. The fixing device according to claim 1, wherein the fuser pad and the heat pipe contact each other only where the first and second coupling portions engage each other.

6. The fixing device according to claim 1, wherein the fuser pad is formed of heat-resistant resin.

7. The fixing device according to claim 1, wherein the heat pipe comprises a tubular piece of sheet metal having a thickness equal to or smaller than approximately 0.2 millimeters.

8. The fixing device according to claim 1, wherein the heat pipe comprises a tubular piece of sheet metal that exhibits a Vicker's hardness not exceeding 280 HV.

9. The fixing device according to claim 1, wherein the heat pipe is formed of ferritic stainless steel.

10. The fixing device according to claim 1, further comprising:

a reinforcing member disposed inside the loop of the fuser belt to reinforce the fuser pad against pressure from the pressure member, wherein the fuser pad has a contact surface defined on a rear side thereof to contact the reinforcing member, which encompasses at least a maximum width of a recording medium accommodated through the fixing nip.

11. An image forming apparatus, comprising:

an electrophotographic imaging unit to form a toner image on a recording medium; and a fixing device to fix the toner image in place on the recording medium, the fixing device comprising:

a tubular heat pipe formed of a sheet of metal bent into a generally cylindrical configuration with a pair of opposed longitudinal edges thereof spaced apart from each other to define a longitudinal slot therebetween;

a rotatable, flexible fuser belt looped for rotation around the heat pipe, with variable clearance between the inner surface of the fuser belt and the outer surface of the heat pipe;

a heater disposed within the heat pipe to heat the heat pipe to conduct heat to the fuser belt;

an elongated, stationary fuser pad accommodated in the longitudinal slot of the heat pipe inside the loop of the fuser belt;

a rotatably driven pressure member disposed parallel to the heat pipe with the fuser belt interposed between the fuser pad and the pressure member, the pressure member pressing against the fuser pad through the fuser belt to form a fixing nip therebetween, through which the recording medium is conveyed under heat and pressure; and a coupling mechanism comprising:

a pair of first coupling portions in the fuser pad, one on each longitudinal edge of the fuser pad; and a pair of second coupling portions in the heat pipe, one in each of the pair of opposed longitudinal edges of the bent sheet of metal, the first coupling portion engageable with the second coupling portion to couple together the pair of opposed longitudinal edges to retain the heat pipe in the generally cylindrical configuration, wherein a minimum clearance between the fuser belt and the heat pipe at a normal, room temperature exceeds an amount of deformation of the heat pipe during warm-up, but does not exceed an amount of deformation of the heat pipe upon completion of warm-up.

* * * * *